US005287975A

United States Patent [19]

Chumley et al.

[11] Patent Number: 5,287,975

[45] Date of Patent: Feb. 22, 1994

[54] CONTINUOUS CYCLE APPARATUS FOR SEPARATING PRECIOUS METALS FROM CONCENTRATE

[75] Inventors: Daniel G. Chumley, Northglenn; Michael C. Basford, Denver, both of Colo.

[73] Assignee: Midan Incorporated, Henderson, Colo.

[21] Appl. No.: 41,007

[22] Filed: Mar. 31, 1993

[51] Int. Cl.[5] ..... B03B 1/00; B03B 7/00

[52] U.S. Cl. ..... 209/3; 209/18; 209/458; 210/195.3

[58] Field of Search ..... 209/3, 13, 17, 18, 44, 209/208, 210, 211, 454, 458; 210/137, 195.3, 512.1

[56] References Cited

U.S. PATENT DOCUMENTS

| | | | |
|---|---|---|---|
| 1,352,882 | 9/1920 | Donegan | 209/18 |
| 1,491,296 | 4/1924 | France | 209/18 |
| 1,632,210 | 6/1927 | Baldwin et al. | 209/18 X |
| 4,319,985 | 4/1982 | Hibbard | 209/3 |
| 4,525,270 | 6/1985 | McCann | 209/44 |
| 4,642,180 | 2/1987 | Kaufman | 209/44 |
| 4,826,251 | 5/1989 | Balkus | 299/7 |
| 5,032,276 | 7/1991 | Mackrle et al. | 210/195.3 X |
| 5,108,584 | 4/1992 | Brosseuk | 209/44 |

FOREIGN PATENT DOCUMENTS

| | | | |
|---|---|---|---|
| 0100595 | 4/1937 | Australia | 209/13 |

*Primary Examiner*—D. Glenn Dayoan
*Assistant Examiner*—Tuan N. Nguyen
*Attorney, Agent, or Firm*—Dorr, Carson, Sloan & Peterson

[57] ABSTRACT

A continuous cycle apparatus for separating particles of precious metals from concentrate having a funnel-shaped hopper. A pump circulates a portion of the water from a sump into the hopper to create a vortex of water and concentrate such that less dense material tends to overflow from the hopper into the sump. The pump also circulates a portion of the water from the sump through a tube connected to a bottom opening in the hopper to transport concentrate and water to a sluice box which collects particles of precious metals contained in the slurry. The rate at which water and concentrate are drawn from the hopper is adjustably controlled by a metering rod located in the tube immediately below the bottom opening in the hopper. The water and remaining particles drain from the sluice box back into the hopper to complete the cycle.

17 Claims, 3 Drawing Sheets

Fig. 4
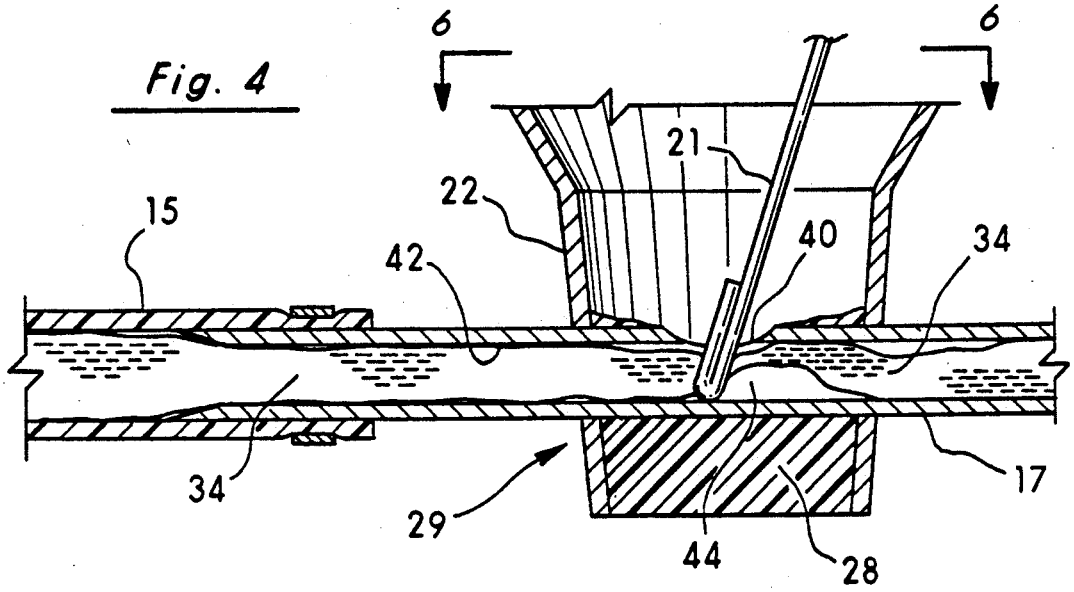
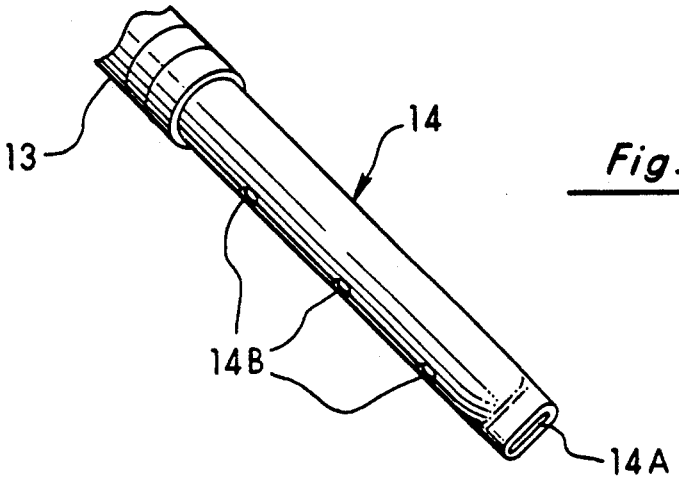
Fig. 5
Fig. 6
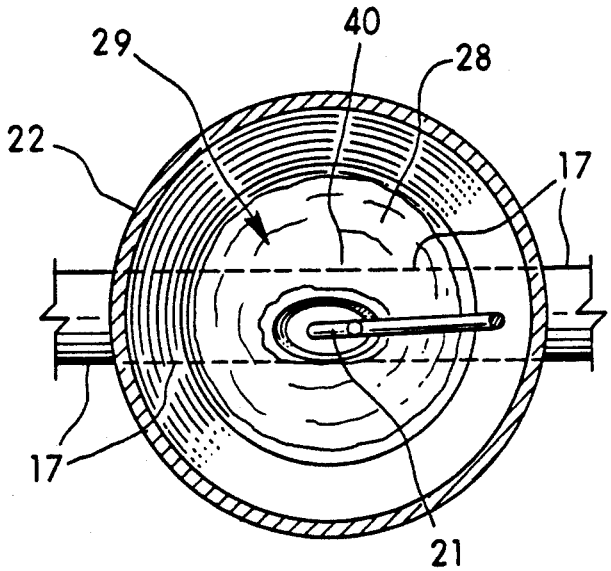

CONTINUOUS CYCLE APPARATUS FOR SEPARATING PRECIOUS METALS FROM CONCENTRATE

BACKGROUND OF THE INVENTION

1. Field of the Invention

The present invention relates generally to the field of separating particles of precious metals. More specifically, the present invention discloses a continuous cycle apparatus for separating precious metals from concentrate.

2. Statement of the Problem

Placer mining operations present a number of unique problems in separating gold particles from common materials. At the small end of the scale, many of these same difficulties also arise in gold panning operations. Namely, these types of mining operations produce relatively small quantities of concentrate that must then be further processed to separate out the particles of gold or other precious metals contained therein. In many cases, these gold particles are so minute that conventional separation devices are less than completely effective in recovering the available metal values.

Another problem arises from the small scale of many placer mining operations. This makes large capital expenditures for equipment difficult to justify from an economic point of view. Therefore, separation equipment for use in small mining facilities must be relatively inexpensive to purchase repair, and operate. Finally, many mining operations are located in remote and rugged locations. This dictates that separation equipment should be compact, easy to transport, and suitable for use in hostile environmental conditions.

A number of systems for separating precious metals from common materials have been invented in the past, including the following:

| Inventor | Pat. No. | Issue Date |
|---|---|---|
| Hibbard | 4,319,985 | Mar. 16, 1982 |
| McCann | 4,525,270 | June 25, 1985 |
| Kaufman | 4,642,180 | Feb. 10, 1987 |
| Balkus | 4,826,251 | May 2, 1989 |
| Brosseuk | 5,108,584 | Apr. 28, 1992 |

Hibbard discloses a gold concentrator having a housing at the end of a sluice into which a quantity of sand, rock and gold particles is deposited. A hose delivers water under pressure to create a suspension of particles and water in the housing. The suspension flows downwardly into a series of sluices which trap the gold particles.

McCann discloses a system for separating heavy minerals, such as gold, silver, and the like, from common material by applying water to the mixture of materials and allowing their different specific gravities to separate them in a sluice holding a riffle mat. A pump 17 recirculates water from a reservoir back into the feed hopper 38. A portion of the flow 21 is directed upward from the bottom of the feed hopper. Another portion of the flow is directed through apertures 23 in the hopper's walls. The resulting slurry flows out through apertures in the bottom of the hopper to enter the sluice.

Kaufman discloses a portable apparatus for recovery of placer gold. The apparatus includes an inclined riffle board containing holes through which jet of air flow to separate gold particles from pulverized ore, sand, debris, and the like. An attached bellows provides the required air flow.

Balkus discloses a dredging platform having a water pump that creates suction in a hose for drawing loose materials from the bottom of a stream into the hose for transport to a sluice and vibratory screen.

Brosseuk discloses an apparatus for extracting heavy metals from ore having a perforated inner drum and a rotating, inclined outer drum with a spiral vane extending the length of its inner surface. A spray of water is directed onto ore contained in the inner drum. A sluice box receives the slurry of water and ore particles discharged from the upper end of the outer drum.

3. Solution to the Problem

None of the prior art references uncovered in the search show a continuous cycle apparatus for separating gold particles having the structure of the present invention. In particular, the unique funnel-shaped hopper (and metering rod) of the present system provide an effective and efficient means for separating gold particles from concentrate. In addition, the present system is inexpensive to build and maintain, and can be easily transported for use in remote locations.

SUMMARY OF THE INVENTION

This invention provides a continuous cycle apparatus for separating particles of precious metals from concentrate. The concentrate to be processed is initially loaded into a funnel-shaped hopper. A pump circulates water from a sump into the hopper to create a vortex of water and concentrate such that less dense material tends to overflow from the hopper into the sump. The pump also circulates a portion of the water from the sump through a tube connected to a bottom opening in the hopper to transport concentrate and water to a sluice box which collects particles of precious metals contained in the slurry. The rate at which water and concentrate are drawn from the hopper is adjustably controlled by a metering rod located in the tube immediately below the bottom opening in the hopper. The water and remaining particles drain from the sluice box back into the hopper to complete the cycle.

A primary object of the present invention is to provide an inexpensive system for separating precious metals from concentrate that is suitable for use by small placer mining operations.

Another object of the present invention is to provide a system that can more efficiently and effectively separate very fine particles of precious metals than has heretofore been possible.

Yet another object of the present invention is to provide a system that is relatively compact and light weight and that can be readily transported to remote locations.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 4 is a fragmentary cross-sectional view of the bottom of the funnel-shaped hopper showing the metering rod.

FIG. 5 is a detail perspective view of the circulating jets.

FIG. 6 is a top view of the funnel-shaped hopper showing the metering rod and the bottom opening in the hopper.

DETAILED DESCRIPTION OF THE INVENTION

Figure 1:
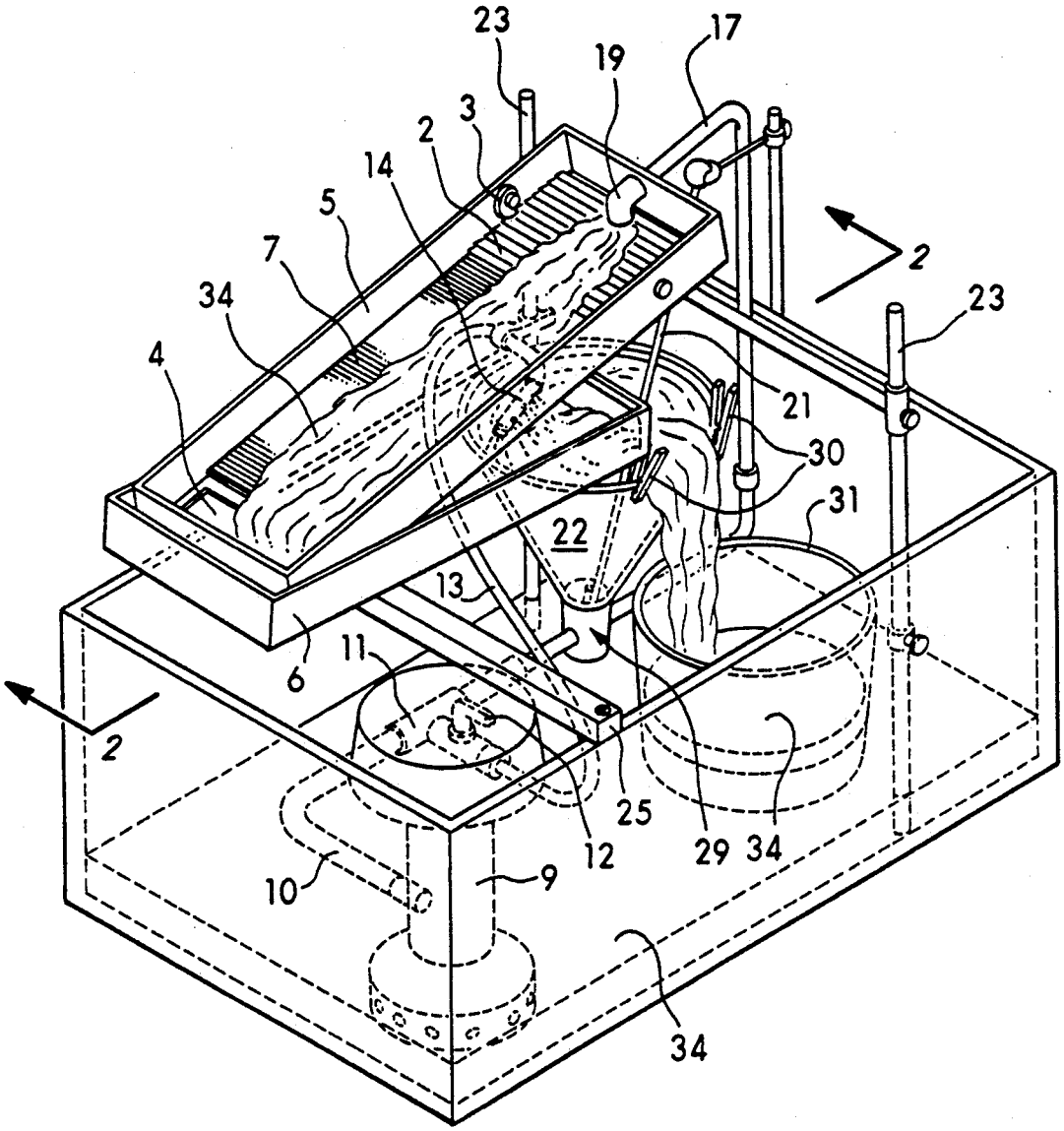
FIG. 1 is an overall perspective of the entire apparatus.
Figure 2:
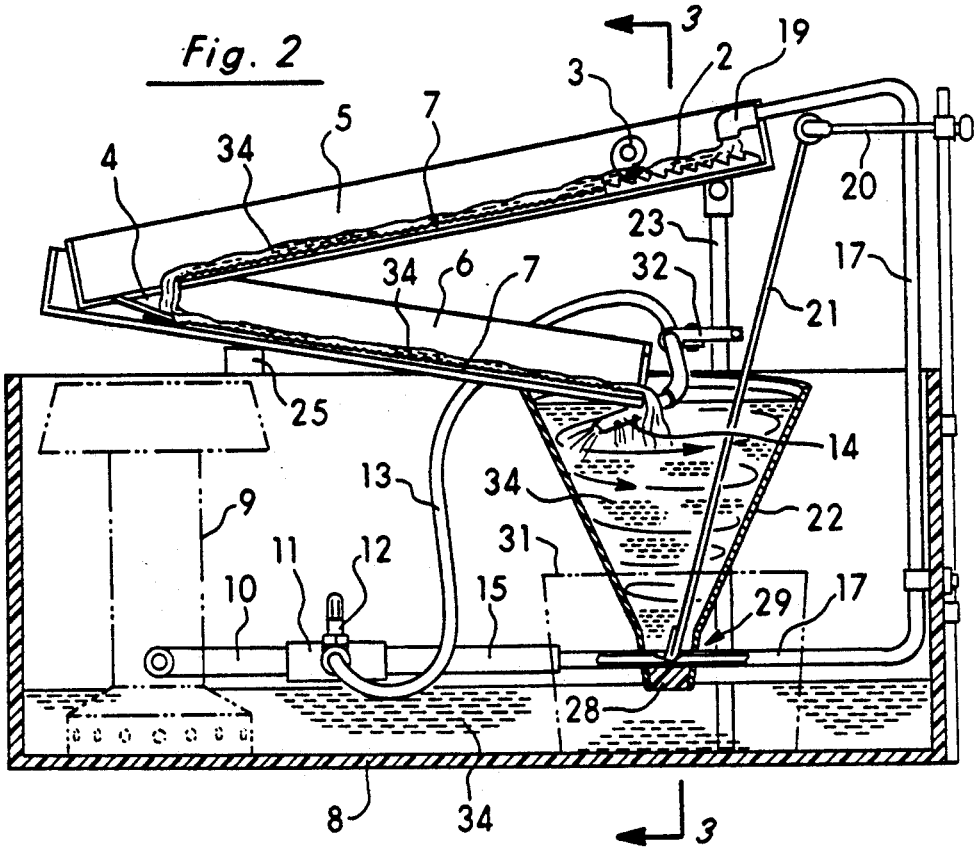
FIG. 2 is a side cross-sectional view taken through the funnel-shaped hopper.
Figure 3:
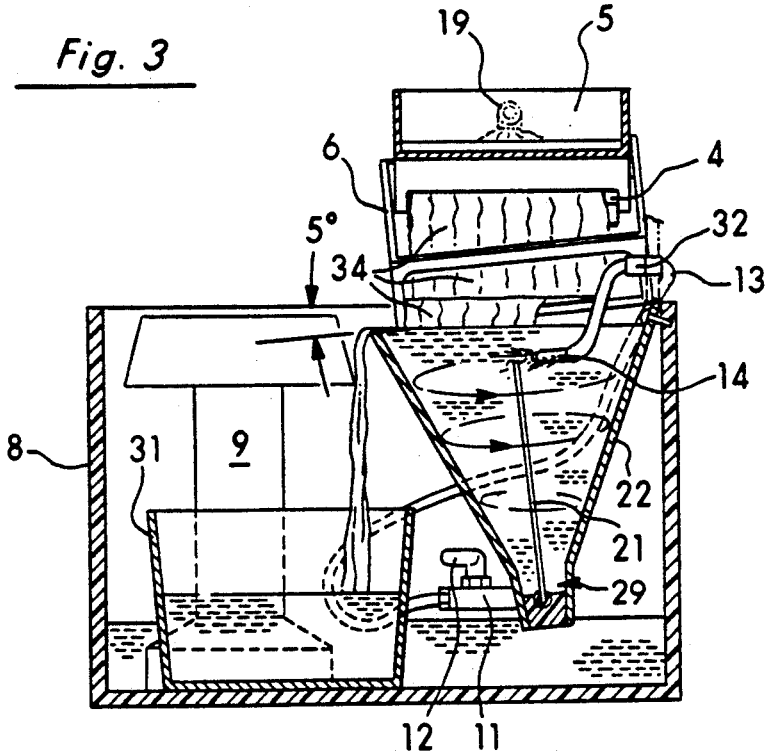
FIG. 3 is a front cross-sectional view taken through the funnel-shaped hopper at ninety degrees to FIG. 2.

Turning to FIG. 1, a perspective view of the apparatus is provided. Corresponding cross-sectional views are shown in FIGS. 2 and 3. To maintain a closed system, the entire apparatus is housed in a water-tight plastic box 8. The lower portion of the box 8 serves as a sump holding a quantity of solution 34 used as the working fluid. The solution 34 is normally water containing a small amount of a surfactant, such as sodium hydroxide, soap, or a detergent.

A hopper 22 is initially filled with a quantity of finely-divided concentrate to be processed that includes particles of a precious metal. The hopper 22 is generally funnel shaped, having a smaller bottom opening and a larger upper opening. The upper opening is used to initially load the concentrate into the hopper, and also for discharging any overflow from the hopper into the sump, as will be described in greater detail below.

A pump assembly 9 sitting on a perforated riser supplies solution 34 from the sump via a main hose 10 to a T-coupling 11. At the coupling 11, the flow is split by a ball valve 12 between a secondary hose 15 and a circulating jet hose 13. The circulating jet hose 13 has a diameter that is approximately one half of the diameter of the main hose 10. This circulating jet hose 13 extends into the funnel-shaped hopper 22 and terminates in a short rigid tube 14 having a number of circulating jets 14*a* and 14*b* (shown most clearly in FIG. 5). The circulating jet hose is secured by a clamp 32 in position with the circulating jets located approximately two inches below the top opening of the funnel hopper 22. In the preferred embodiment shown in the drawings, the rigid tube 14 is perforated by three equally spaced holes 14*a* (approximately 1/32 inch in diameter) pointed in a tangential direction along the wall of the funnel hopper 22. In addition, the distal end of the tube is pinched vertically to approximately one quarter of the diameter of the circulating jet hose 13 to form yet another jet 14*b* as shown in FIG. 5. These jets 14*a* and 14*b* assist in formation of a vortex of water and concentrate particles within the funnel hopper 22 in which less dense material tends toward the upper portion of the hopper and denser material tends to sink toward the bottom opening of the funnel hopper 22. The Coriolis effect favors a counter-clockwise rotation of the vortex for locations in the northern hemisphere. Therefore, the jets 14*a* and 14*b* are directed to cause counter-clockwise rotational flow within the funnel hopper 22.

As shown generally in FIG. 2 and in more detail in FIG. 4, the secondary hose 15 carries the balance of the flow of solution 34 from the T-coupling 11 through a tube 42 sealed in fluid communication with the bottom opening 40 of the funnel hopper 22. In the preferred embodiment, this tube 42 houses a metering valve 29 which regulates the rate at which concentrate and water flow out of the hopper and are transported by the passing flow in the tube 42. In particular, the metering valve 29 consists of a metering rod 21 that extends downward through the funnel hopper 22 and its bottom opening 40 into the tube 42. The lower end of the metering rod 21, located within the tube adjacent to the bottom opening 40 of the hopper 22, is enlarged to effectively serve as a valve plate. This is shown most clearly in the side cross-sectional view of FIG. 4 and the top view of FIG. 6. The metering rod 21 creates a low pressure area 44 behind the metering rod 21 to draw water and denser, gold-bearing material through the bottom opening 40 of the funnel hopper 22. After initial adjustment, the metering rod is secured in its desired orientation and location by a clamp 20.

The effluent leaving the metering valve 29 is carried through a transfer hose 17 and exits via a discharge port 19 into the sluice assembly 2–7. The sluice assembly consists of a riffle 2 secured by riffle dogs 3. The riffle acts to disperse effluent 34 evenly over the surface of the top sluice 5 which is lined with a grooved mat 7 to trap any particles of gold or other precious metals carried in the effluent. The top sluice tray 5 maintains a downward slope from inlet to outlet, while being essentially level from side to side. The top sluice 5 is supported by an adjustable frame 23. The effluent drains through an outlet 4 at the lower end of the top sluice 5 onto the upper end of the bottom sluice 6. The outlet at the lower end of the top sluice 5 can optionally accommodate a brass screen overlay to catch unwanted oversized stones that enter the system through sloppy classification of the concentrate. The upper end of the bottom sluice 6 is supported in a generally level lateral orientation by an adjustable support 25. The bottom sluice 6 is also lined with a grooved mat beginning approximately three inches from its upper end. The lower end of the bottom sluice 6 is tilted laterally by about five degrees. This causes the water and remaining particles discharged from the sluice to flow back into the hopper as a single, well defined stream that reinforces the vortex circulation within the funnel hopper 22. It should be expressly understood that the number of sluice boxes is largely arbitrary, and that more or fewer sluice box segments could be connected in series.

As shown most clearly in FIG. 3, the funnel hopper 22 is tilted laterally by a small degree (e.g. five degrees) so that the overflow tends to leave the upper rim of the hopper 22 in a well defined stream. The width and location of the overflow stream can be further regulated by placement of two current deflectors 30 (e.g. clothes pins) attached to the upper rim of the hopper 22. A catch pan 31 receives this overflow from the funnel hopper 22. It should be recalled that the vortex within the funnel hopper 22 tends to cause less dense material in the concentrate to be carried with the overflow from the hopper 22. Therefore, the lighter particles gradually are carried out of the hopper by the overflow stream and collect in the bottom of the catch pan 31. Water overflows the rim of the catch pan 31 and drains back into the sump at the bottom of the plastic box 8 where it can be recirculated by the pump 9. This filtering action by catch pan 31 to remove particles from the return flow reduces wear on the pump 9.

The process is complete when the funnel hopper 22 is empty. The amount of time necessary will vary with the quantity and quality of the concentrate being processed.

The above disclosure sets forth a number of embodiments of the present invention. Other arrangements or embodiments, not precisely set forth, could be practiced under the teachings of the present invention and as set forth in the following claims.

We claim:

1. A continuous cycle apparatus for separating particles of precious metals from concentrate comprising:

a funnel-shaped hopper having a smaller bottom opening and a larger upper opening for initially receiving a quantity of concentrate to be processed and for discharging any overflow from said hopper;

a tube having an opening sealed in fluid communication with said bottom opening of said hopper;

a sump for holding a quantity of water and for receiving said overflow from said hopper;

means for circulating a first flow of water from said sump into said hopper to create a vortex of said water and said concentrate in said hopper such that less dense material tends to overflow from said hopper into said sump;

means for circulating a second flow of water from said sump through said tube to transport a portion of said concentrate and water from said bottom opening of said hopper; and a sluice box for collecting particles of precious metals from said flow delivered by said tube, said sluice box further having a discharge to circulate said flow back into said hopper.

2. The apparatus of claim 1 further comprising a metering valve to regulate the rate at which concentrate and water flow out of said bottom opening of said hopper into said tube.

3. The apparatus of claim 2 wherein said metering valve comprises a rod extending through said hopper having an enlarged lower end located in said tube adjacent to said bottom opening of said hopper.

4. The apparatus of claim 1, wherein said means for circulating a first flow of water from said sump into said hopper to create a vortex of said water and said concentrate in said hopper comprises a number of jets directing said first flow of water in a tangential direction within said hopper.

5. The apparatus of claim 1, wherein said vortex of said water and said concentrate in said hopper rotates in a counter-clockwise direction.

6. The apparatus of claim 1, wherein said water further comprises a surfactant.

7. The apparatus of claim 1, wherein said sluice box is comprised of a plurality of segments connected in series, and wherein the last of said segments is tilted laterally so that said discharge flows back into said hopper as a single stream.

8. A continuous cycle apparatus for separating particles of precious metals from concentrate comprising:

a sump for holding a quantity of water;

a funnel-shaped hopper having a smaller bottom opening and a larger upper opening for initially receiving a quantity of concentrate to be processed and for discharging any overflow from said hopper into said sump;

a pump for circulating a flow of said water from said sump;

at least one jet receiving a first portion of said flow of water from said pump and directing said flow into said hopper to create a vortex of water and concentrate in which less dense material tends to overflow from said hopper into said sump and denser material tends to gravitate toward said bottom opening of said hopper;

a tube having an opening sealed in fluid communication with said bottom opening of said hopper, said tube carrying a second portion of said flow of water from said pump and receiving a flow of concentrate and water through said bottom opening of said hopper;

a sluice box for collecting particles of precious metals from said flow delivered by said tube, said sluice box further having a discharge to circulate said flow back into said hopper.

9. The apparatus of claim 8 further comprising a metering valve to regulate the rate at which concentrate and water flow out of said bottom opening of said hopper into said tube.

10. The apparatus of claim 9, wherein said metering valve comprises a rod extending through said hopper having an enlarged lower end located in said tube adjacent to said bottom opening of said hopper.

11. The apparatus of claim 8, wherein said water further comprises a surfactant.

12. The apparatus of claim 8, wherein said sluice box is comprised of a plurality of segments connected in series, and wherein the last of said segments is tilted laterally so that said discharge flows back into said hopper as a single stream.

13. The apparatus of claim 8, wherein said jets direct said flow of water in a tangential direction within said hopper.

14. The apparatus of claim 8, wherein said vortex of said water and said concentrate in said hopper rotates in a counter-clockwise direction.

15. A continuous cycle apparatus for separating particles of precious metals from concentrate comprising:

a sump for holding a quantity of water;

a funnel-shaped hopper having a smaller bottom opening and a larger upper opening for initially receiving a quantity of concentrate to be processed and for discharging any overflow from said hopper into said sump;

a pump for circulating a flow of said water from said sump;

at least one jet receiving a first portion of said flow of water from said pump and directing said flow in a tangential direction into said hopper to create a vortex of water and concentrate in which less dense material tends to overflow from said hopper into said sump and denser material tends to gravitate toward said bottom opening of said hopper;

a tube having an opening sealed in fluid communication with said bottom opening of said hopper, said tube carrying a second portion of said flow of water from said pump and receiving a flow of concentrate and water through said bottom opening of said hopper;

a metering valve having a rod extending through said hopper and an enlarged lower end located in said tube adjacent to said bottom opening of said hopper to regulate the rate at which concentrate and water flow out of said bottom opening of said hopper into said tube;

a sluice box for collecting particles of precious metals contained in said flow delivered by said tube, said sluice box further having a discharge to circulate said flow back into said hopper.

16. The apparatus of claim 15, wherein said sluice box is comprised of a plurality of segments connected in series, and wherein the last of said segments is tilted laterally so that said discharge flows back into said hopper as a single stream.

17. The apparatus of claim 15, wherein said vortex of said water and said concentrate in said hopper rotates in a counter-clockwise direction.

* * * * *